US009341010B2

(12) United States Patent
Pyo

(10) Patent No.: US 9,341,010 B2
(45) Date of Patent: May 17, 2016

(54) FURNITURE DOOR POSITION ADJUSTMENT DEVICE FOR FURNITURE HINGE

(71) Applicant: Samsung Precision Ind. Co., Ltd., Incheon (KR)

(72) Inventor: Cheol Soo Pyo, Gwacheon-si (KR)

(73) Assignee: SAMSUNG PRECISION IND. CO., LTD., Incheon (KR)

( * ) Notice: Subject to any disclaimer, the term of this patent is extended or adjusted under 35 U.S.C. 154(b) by 0 days.

(21) Appl. No.: 14/419,923

(22) PCT Filed: Oct. 30, 2013

(86) PCT No.: PCT/KR2013/009744
§ 371 (c)(1),
(2) Date: Feb. 5, 2015

(87) PCT Pub. No.: WO2014/073817
PCT Pub. Date: May 15, 2014

(65) Prior Publication Data

US 2015/0191952 A1 Jul. 9, 2015

(30) Foreign Application Priority Data

Nov. 6, 2012 (KR) ..... 10-2012-0124846

(51) Int. Cl.
*E05D 7/06* (2006.01)
*E05D 7/04* (2006.01)
*E05D 7/00* (2006.01)

(52) U.S. Cl.
CPC ..... *E05D 7/0009* (2013.01); *E05D 7/04* (2013.01); *E05D 7/0407* (2013.01);

(Continued)

(58) Field of Classification Search
CPC ..... Y10T 16/5321; Y10T 16/5322; Y10T 16/53225; Y10T 16/53253; Y10T 16/53257; E05D 7/04; E05D 7/0423; E05D 7/0415; E05D 7/043; E05D 2007/0438; E05D 2007/0446; E05D 2007/0453; E05D 2007/0461; E05D 2007/0476; E05D 2007/0484; E05D 2007/0492; E05Y 2900/20
See application file for complete search history.

(56) References Cited

U.S. PATENT DOCUMENTS 3,863,292 A * 2/1975 Grunert et al. ..... 16/236
4,159,557 A * 7/1979 Pittasch et al. ..... 16/237

(Continued)

FOREIGN PATENT DOCUMENTS

JP 10-306643 A 11/1998
JP 2002194941 A * 7/2002

(Continued)

OTHER PUBLICATIONS

PCT International Search Report mailed Feb. 28, 2014, in related International Application No. PCT/KR2013/009744.

*Primary Examiner* — Chuck Mah
(74) *Attorney, Agent, or Firm* — Haynes & Boone, LLP

(57) ABSTRACT

The present invention relates to a furniture hinge that is mounted between a furniture wall body and a furniture door so as to be used as an opening and closing means for the furniture door. The present invention includes: a long concave hole (50) that is formed in a main body portion (110); an elastic piece (10) that is formed in a middle plate (140) so as to perform a buffering function in the vertical direction; an oblong hole (20) that is formed in the elastic piece (10); a rotor (30) which is accommodated in the oblong hole (20) and which has a step protrusion (32) that is formed in one side portion on the outer circumference surface thereof; and an eccentric bolt (40) that rotates while being inserted into the long concave hole (50) and is coupled to the rotor (30) through a leg portion (42) for the regular/reverse rotation. The furniture hinge can be finely adjusted and the position of the door can be discerned with the naked eye.

8 Claims, 5 Drawing Sheets

(52) U.S. Cl.
CPC ..... *A47B 2230/0014* (2013.01); *E05D 7/0415* (2013.01); *E05Y 2201/638* (2013.01); *E05Y 2800/268* (2013.01); *Y10T 16/5323* (2015.01)

(56) References Cited

U.S. PATENT DOCUMENTS

| | | | | | |
|---|---|---|---|---|---|
| 5,694,665 | A * | 12/1997 | Strickland et al. | ..... | 16/238 |
| 5,781,966 | A * | 7/1998 | Ferrari et al. | ..... | 16/242 |
| 5,799,370 | A * | 9/1998 | Davidian et al. | ..... | 16/236 |
| 6,134,750 | A * | 10/2000 | Salice | ..... | 16/238 |
| 6,757,938 | B1 * | 7/2004 | di Vinadio | ..... | 16/242 |
| 7,552,511 | B2 * | 6/2009 | Campbell et al. | ..... | 16/238 |
| 2002/0078527 | A1 * | 6/2002 | Mueller et al. | ..... | 16/254 |
| 2002/0166207 | A1 * | 11/2002 | Egger et al. | ..... | 16/240 |
| 2003/0041412 | A1 * | 3/2003 | Mueller et al. | ..... | 16/236 |
| 2004/0163212 | A1 * | 8/2004 | Isele | ..... | 16/235 |
| 2004/0163213 | A1 * | 8/2004 | Isele | ..... | 16/245 |
| 2004/0216272 | A1 * | 11/2004 | Booker et al. | ..... | 16/255 |
| 2006/0137139 | A1 * | 6/2006 | Wu | ..... | 16/236 |
| 2006/0179610 | A1 * | 8/2006 | Erickson et al. | ..... | 16/243 |
| 2007/0289093 | A1 * | 12/2007 | Nallamottu | ..... | 16/236 |
| 2008/0271290 | A1 * | 11/2008 | Chen et al. | ..... | 16/238 |
| 2008/0271291 | A1 * | 11/2008 | Chen et al. | ..... | 16/238 |
| 2009/0089974 | A1 * | 4/2009 | Fries et al. | ..... | 16/243 |
| 2010/0281652 | A1 * | 11/2010 | Oshima | ..... | 16/236 |

FOREIGN PATENT DOCUMENTS

| | | | |
|---|---|---|---|
| KR | 10-2008-0101050 | A | 11/2008 |
| KR | 10-0885529 | B1 | 2/2009 |
| KR | 10-2012-0092406 | A | 8/2012 |

* cited by examiner (PRIOR ART)

(PRIOR ART)

FURNITURE DOOR POSITION ADJUSTMENT DEVICE FOR FURNITURE HINGE

TECHNICAL FIELD

The present invention relates to a furniture hinge that is mounted on a furniture wall so as to be used as an opening/closing means for opening and closing a furniture door, and more particularly, to a furniture door position adjustment device for a furniture hinge, in which a position adjustment mechanism of the furniture hinge is modified to increase a variety of conveniences according to the position adjustment of the furniture door as well as improve the precision of the work.

BACKGROUND ART

In general, a furniture hinge is an iron structure which is used as a means for opening and closing a door of various kinds of furniture pieces including dressers, sinks, and the like. First of all, it is important that the furniture hinge provides improved convenience and workability during the position setting of a furniture door as well as minimizes noises or positional displacement occurring in the course of opening and closing the furniture door.

In this case, the furniture hinge includes a mounting plate securely fixed to a wall of a piece of furniture and a rotating plate securely fixed to the furniture door. Particularly, the mounting plate is coupled to a body of the furniture hinge by means of a bolt or a retaining hook so that the opening and closing position of the furniture door is adjusted through the change in the position of the mounting plate.

For example, as shown in FIGS. 1 and 2, a furniture hinge 100 includes a body 110, a rotating plate 120 securely fixed to a furniture door D in such a manner as to be hingedly coupled to one end of the body 110, and a mounting plate 130 securely fixed to a furniture wall B in such a manner as to be coupled to a lower portion of the body 110.

In addition, the body 110 has an engagement hole 112 formed thereon for allowing a fixing bolt 132 to be engaged therewith and a tension hole 114 formed thereon for allowing a tension bolt 134 to be engaged therewith, the engagement hole and the tension hole being spaced apart from each other by a predetermined interval. The mounting plate 130 has a bolt hole 136 formed thereon for allowing the fixing bolt 132 to be engaged therewith and an engagement hole 138 formed thereon for allowing the tension bolt 134 to be engage therewith, the bolt hole and the engagement hole being spaced apart from each other by a predetermined interval.

Thus, in the case where it is desired to set the furniture door D, the body 110 is slightly shifted to a desired position in such a manner that the body 110 is moved in the longitudinal direction thereof relative to the fixing bolt 132 in the engagement hole 112 thereof in a state in which the fixing bolt 132 is slightly loosened. Thereafter, when the fixing bolt 132 is again tightened, the position adjustment work of the furniture door D is completed.

However, the conventional furniture hinge 100 entails a problem in that since it is very difficult to loosen and tighten the fixing bolt 132 while allowing the body 110 to abut against the mounting plate 130 due to the weight of the furniture door D itself in the process of setting the furniture door D, a work force of two persons or so is needed, leading to an increase in the work load.

Furthermore, for the conventional furniture hinge 100, a series of work processes in which the position of the body 110 is set are performed according to intuition of a worker only in such a manner that the body 110 is shifted in the longitudinal direction thereof relative to the fixing bolt 132 in the engagement hole 112 and the fixing bolt 132 is again tightened, thereby making an accurate setting work of the furniture door D difficult and degrading the precision of the work, and thus decreasing reliability.

Meanwhile, as shown in FIG. 3, in an attempt to solve a problem associated with the setting of the furniture hinge 100, there has been proposed an improved furniture hinge in which the body 110 has a recessed slit 116 and a guide hole 118, which are formed thereon instead of the engagement hole 112 and the tension hole 114 of FIG. 2 and an eccentric bolt 150 having a leg 152 is used instead of the fixing bolt 132 of FIG. 2.

Thus, in the case where it is desired to set the furniture door D, when the eccentric bolt 150 is rotated in a forward or reverse direction, the body 110 is moved forwardly or rearwardly by the eccentric action of the leg 152. Like this, the position of the furniture door D can be set only through the rotation of the eccentric bolt 150.

However, the eccentric bolt 150 does not include any means suitable for controlling an external load applied thereto from the furniture door D. For example, in the case where the leg 152 is positioned at an intermediate portion of the recessed slit 116 as shown in FIGS. 4(*b*) to 4(*d*), but not positioned at both ends of the recessed slit 116 as shown in FIGS. 4(*a*) and 4(*e*), the eccentric bolt 150 is rotated by means of an external load applied to the furniture door D, thus causing a problem in that the furniture door D is frequently displaced.

Therefore, there is an urgent need for the research and development of a novel furniture hinge which improves the position adjustment mechanism of the furniture hinge 100 to increase a variety of conveniences according to the position adjustment of the furniture door D and includes a separate means to control an external load applied to the furniture door D to prevent the furniture door D from being displaced.

DISCLOSURE OF INVENTION

Technical Problem

Accordingly, the present invention has been made to solve the above-mentioned problems occurring in the prior art, and it is an object of the present invention to provide a furniture door position adjustment device for a furniture hinge, in which a position adjustment mechanism of the furniture hinge is modified to increase a variety of conveniences according to the position adjustment of the furniture door as well as improve the precision of the work.

Technical Solution

To achieve the above objects, the present invention provides a furniture door position adjustment device for a furniture hinge including a body disposed between a furniture wall and a furniture door, a rotating plate securely fixed to the furniture door in such a manner as to be hingedly coupled to the body, and a mounting plate securely fixed to the furniture wall by means of an intermediate plate in such a manner as to be coupled to the body, the device including: a slit formed on a recessed portion of the body; an elastic piece formed at a side of the intermediate plate so as to perform a buffering function in a vertical direction, the elastic piece having an elliptical hole formed thereon; a rotator configured to be accommodated in the elliptical hole of the intermediate plate, the rotator having a plurality of engagement protrusions partially formed on the outer peripheral surface thereof; and an eccentric bolt having a leg formed on the underside thereof and configured to be coupled to the rotator by means of the leg so as to rotate the rotator in a forward or reverse direction upon the forward or reverse rotation of the eccentric bolt in a state in which the leg is inserted into the recessed slit, whereby the rotator is retained on the inner peripheral surface of the elliptical hole or is moved forwardly or rearwardly along the inner peripheral surface of the elliptical hole in the forward or reverse rotation of the eccentric bolt to fix the position of the body or move the body forwardly or rearwardly.

Advantageous Effects

The furniture door position adjustment device for a furniture hinge according to the present invention has the following advantageous effects.

First, the position adjustment operation of the furniture door is performed in a one-touch manner by the interaction between the elliptical hole and the rotator in a series of work processes according to the position adjustment of the furniture hinge so that the furniture hinge can be adjusted finely and the position of the door can be identified with the naked eyes.

Second, in the case where the position adjustment of the furniture hinge is completed, the position of the intermediate plate is set in a state of being always fixedly held in place through the mutual engagement action between the elliptical hole and the rotator, thereby preventing any positional displacement of the furniture door.

Third, even though an excessive pressure is applied to the furniture door, the furniture door is not displaced through the mutual engagement action between the elliptical hole and the rotator so that the furniture door is always set in place, thereby enhancing reliability.

BRIEF DESCRIPTION OF THE DRAWINGS

The above and other objects, features and advantages of the present invention will be apparent from the following detailed description of the preferred embodiments of the invention in conjunction with the accompanying drawings, in which.

Figure 1:
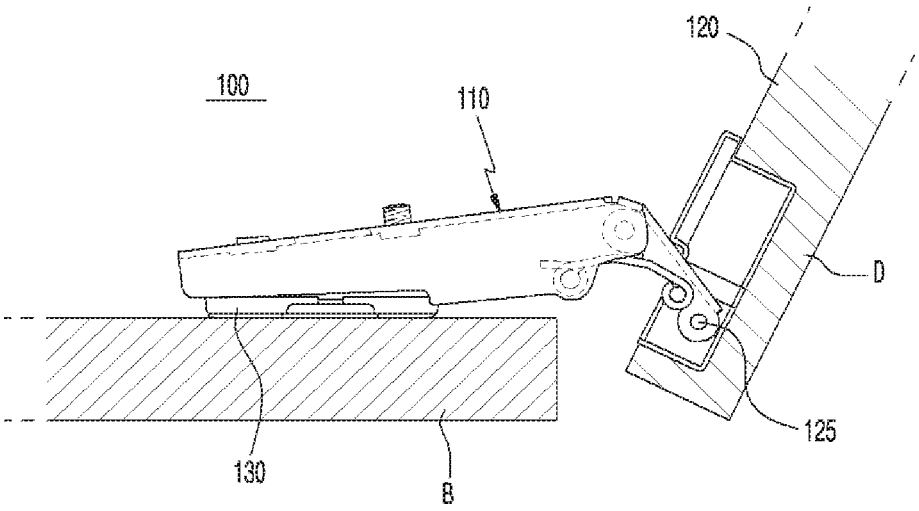
FIG. 1 is a view illustrating a state in which a furniture hinge according to the prior art is installed at a piece of furniture.
Figure 2:
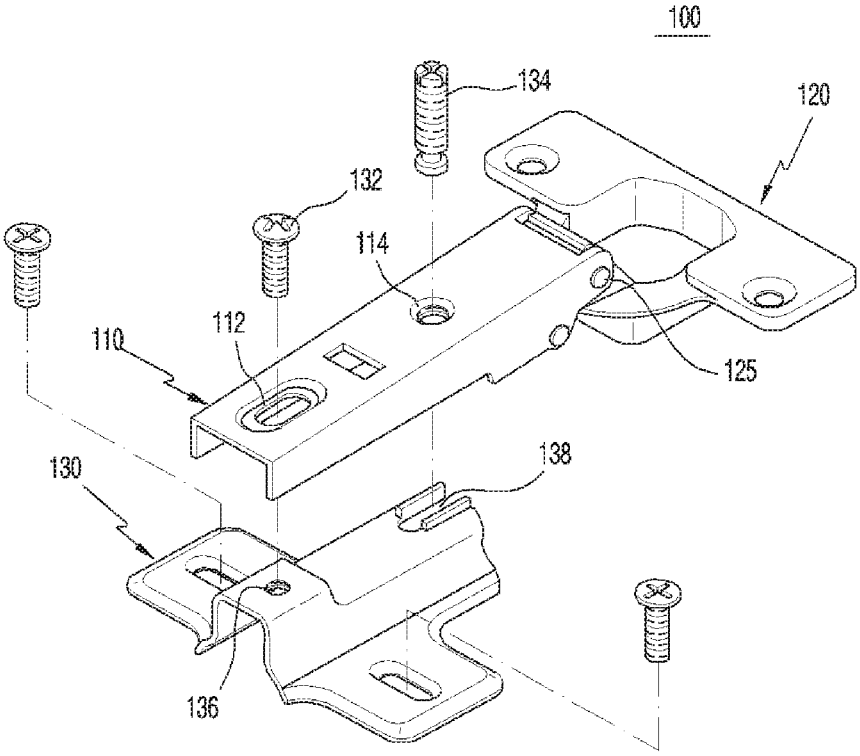
(PRIOR ART) FIG.2
FIG. 2 is an exploded perspective view illustrating one example of a furniture hinge according to the prior art.
Figure 3:
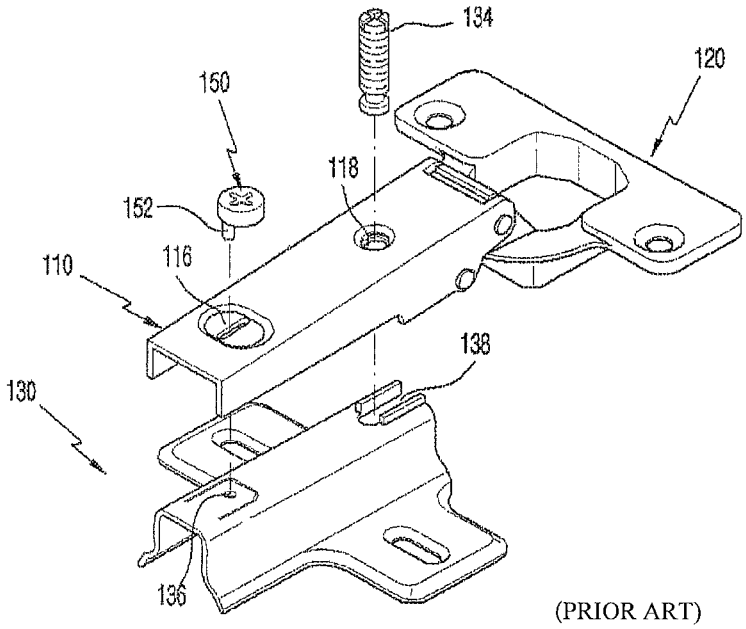
FIG. 3 is an exploded perspective view illustrating another example of a furniture hinge according to the prior art.
Figure 4:
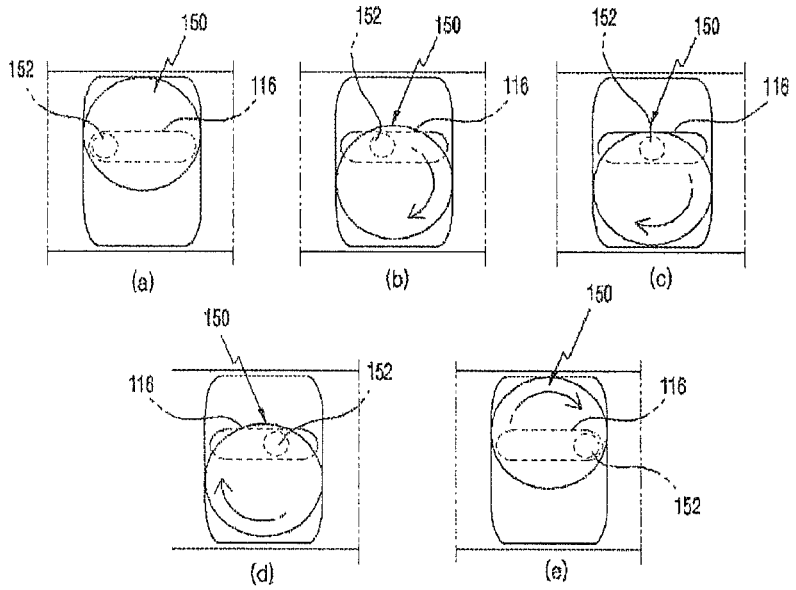
(PRIOR ART) FIG.4
FIGS. 4(*a*) to 4(*e*) are diagrammatic views illustrating a problem involved in the furniture hinge of FIG. 3.
Figure 5:
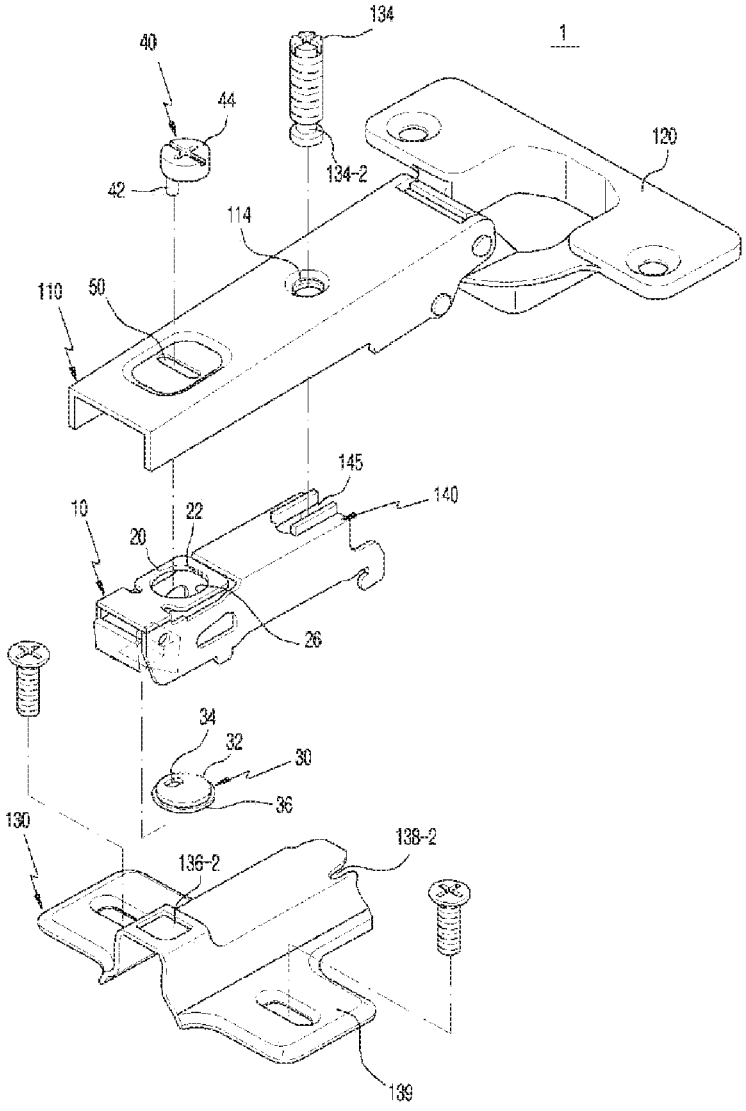
FIG. 5 is an exploded perspective view illustrating a furniture hinge according to the present invention.
Figure 6:
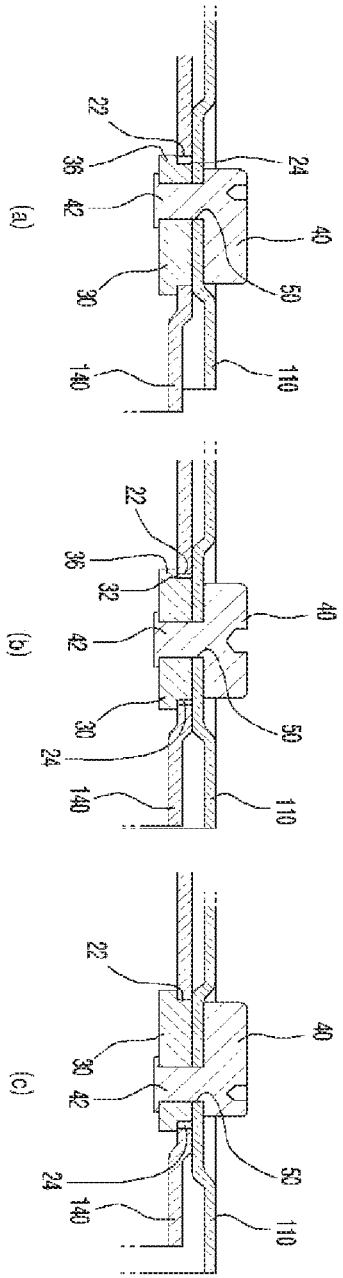
FIG. 6 is a cross-sectional view illustrating a coupled state of a position adjustment mechanism of a furniture hinge according to the present invention.

*Explanation on reference numerals of main elements in the drawings*

| | |
|---|---|
| 1: furniture hinge | 10: elastic piece |
| 20: elliptical hole | 22: engagement groove |
| 24: release gap | 26: movement line |
| 30: rotator protrusion | 32: engagement |
| 34: fitting hole | 36: support step |
| 40: eccentric bolt | 42: leg |
| 44: head | 50: recessed slit |

BEST MODE FOR CARRYING OUT THE INVENTION

Now, a preferred embodiment of a furniture door position adjustment device according to the present invention will be described hereinafter in detail with reference to FIGS. 5 to 8.

The furniture hinge 1 according to the present invention includes: a body 110 disposed between a furniture wall B and a furniture door D; a rotating plate 120 securely fixed to the furniture door D in such a manner as to be hingedly coupled to one end of the body 110, and a mounting plate 130 securely fixed to the furniture wall B by means of an intermediate plate 140 in such a manner as to be coupled to a lower portion of the body 110.

The furniture door position adjustment device for a furniture hinge includes: a slit 50 formed on a recessed portion of the body 110; an elastic piece 10 formed at a side of the intermediate plate 140 so as to perform a buffering function in a vertical direction, the elastic piece 10 having an elliptical hole 20 formed thereon; a rotator 30 configured to be accommodated in the elliptical hole 20 of the intermediate plate 140, the rotator 30 having a plurality of engagement protrusions 32 partially formed on the outer peripheral surface thereof; and an eccentric bolt 40 having a leg 42 formed on the underside thereof and configured to be coupled to the rotator 30 by means of the leg 42 so as to rotate the rotator 30 in a forward or reverse direction upon the forward or reverse rotation of the eccentric bolt 40 in a state in which the leg 42 is inserted into the recessed slit 50, so that the rotator 30 is retained on the inner peripheral surface of the elliptical hole 20 or is moved forwardly or rearwardly along the inner peripheral surface of the elliptical hole 20 in the forward or reverse rotation of the eccentric bolt 40 to fix or adjust the position of the furniture door D.

First, the furniture hinge 1 according to the present invention is characterized in that the position of the rotator 30 is adjusted by the forward or reverse rotation of the eccentric bolt 40 in a state in which the rotator 30 is accommodated in the elliptical hole 20 so that the position of the body 110 can be fixed or adjusted.

In addition, the body 110 serves to maintain a framework of the furniture hinge 1 and support the total load of the furniture hinge 1. The body 110 is configured such that it is disposed between the furniture wall B and the furniture door D, and the recessed slit 50 with which the eccentric bolt 40 is engaged and a tension hole 114 with which the tension bolt 134 is engaged are formed in such a manner as to be spaced apart from each other by a predetermined interval.

In this case, the recessed slit 50 is preferably formed on a top surface of the body 110 in the transverse direction of the body 110 so as to guide the rotation direction of the eccentric bolt 40.

Also, the tension bolt 134 and the tension hole 114 may be formed in various shapes to conform to the specification and size of the furniture hinge 1, In particular, it is, of course, to be noted that each of the tension bolt 134 and the tension hole 114 falls within the technical scope of the present invention irrespective of the shape and length thereof as long as it is configured in the furniture hinge 1 and is used as a tension adjustment means of the furniture door D.

In addition, the tension bolt 134 is rotated forwardly or reversely in a state of being engaged with the tension hole 114, and has a retaining step 134-2 protrudingly formed on a lower end thereof so as to allow an engagement hole 145 of the intermediate plate 140 to be retained on the retaining step 134-2.

Moreover, the eccentric bolt 40 is rotated in the forward or reverse direction in a state of being inserted into the recessed slit 50. The eccentric bolt 40 is composed of a head 44 abutting against a recessed portion forming a periphery of the recessed slit 50 and a leg 42 formed on the underside thereof so as to be biased from the center of the underside thereof so that the leg 42 is inserted into the recessed slit 50.

In addition, the rotating plate 120 is pivotally coupled to one end of the body 110 by means of a hinge shaft 125 (see FIG. 1) so that the rotating plate 120 is pivotally rotated along with the furniture door D upon the pivotal rotation of the furniture door D in a state of being securely fixed to the furniture door D.

Further, the intermediate plate 140 is inserted into an accommodating space defined below the body 110 in a sliding manner so as to guide the forward or rearward movement of the body 110. The intermediate plate 140 has the engagement hole 145 formed on a top surface thereof so as to allow the tension bolt 134 to be engaged therewith and an engagement mechanism formed on a bottom surface thereof so as to be engaged with the mounting plate 130.

In addition, the intermediate plate 140 includes an elastic piece 10 formed on a top surface thereof so as to provide a buffering force, and the elastic piece 10 has an elliptical hole 20 of a predetermined size formed thereon so as to accommodate allow the rotator 30 which will be described later.

Also, the elastic piece 10 refers to a buffering means formed by cutting off the top surface of the intermediate plate 140. Particularly, although a configuration is implemented in which the elliptical hole 20 is formed in a state in which the elastic piece 10 is excluded, it falls within the technical scope of the present invention.

Of course, the elastic piece 10 may be configured by cutting off the intermediate plate 140 or may be attached to the intermediate plate 140.

In addition, the rotator 30 is rotated or moved along the elliptical hole 20 in response to the forward or reverse rotation of the eccentric bolt 40 in a state of being received in the elliptical hole 20. The rotator 30 has a support step 36 formed extending outwardly from a lower peripheral surface thereof so as to be retained by a flange portion of the elliptical hole 20 of the intermediate plate 140 so that the support step 36 is used as an escape-preventive means in the rotation and movement of the rotator 30.

Besides, the rotator 30 has a plurality of engagement protrusions 32 formed on the outer peripheral surface thereof so as to be engagingly coupled with the inner peripheral surface of the elliptical hole 20

Also, the rotator 30 has a fitting hole 34 formed thereon so as to allow the leg 42 of the eccentric bolt 40 to be fittingly inserted thereto and fixed by riveting.

Further, the elliptical hole 20 is formed in a slightly oblong shape on the elastic piece 10 of the intermediate plate 140 in the longitudinal direction of the intermediate plate 140. A space portion of a predetermined size is defined at one side of the elliptical hole 20 so as to provide a fixing space for the rotator 30 and a space portion of a predetermined size is defined at the other side of the elliptical hole 20 so as to provide a movement space for the rotator 30.

In addition, the elliptical hole 20 has a plurality of engagement grooves 22 formed on the inner peripheral surface thereof, i.e., on at least one side of a front end and a rear end thereof relative to the intermediate plate 140 so as to allow the engagement protrusions 32 of the rotator 30 to be selectively engaged therewith to provide the fixing space for the rotator 30.

Also, the elliptical hole 20 has a release gap 24 defined on the inner peripheral surface thereof, preferably in an opposite direction to the direction in which the engagement grooves 22 are formed so as to provide the movement space for the rotator 30 in the separation of the engagement protrusions 32 and the engagement grooves 22.

In addition, the elliptical hole 20 has a rectilinear-shaped movement line 26 formed on both sides of the inner peripheral surface thereof in a direction perpendicular to the direction in which the engagement grooves 22 and the release gap 24 are formed so as to guide the forward or rearward movement of the rotator 30 in the forward or reverse rotation of the rotator 30.

In this case, the number of the engagement protrusions 32 of the rotator 30 is preferably larger than that of the engagement grooves 22 of the elliptical hole 20 so that a range in which the rotator 30 engages with the elliptical hole 20 in the rotation of the rotator 30 is increased.

Further, the mounting plate 130 is hookingly coupled to a lower portion of the body 110, preferably a lower portion of the intermediate plate 140 through an engagement opening 136-2 and an engagement groove 138-2 which are formed thereon in a state in which the mounting plate 130 abuts against the lower portion of either the body 110 or the intermediate plate 140. The mounting plate 130 includes a pair of opposed wing portions 139 of a predetermined size formed at both sides of a body thereof so as to be securely fixed to the furniture wall B.

Hereinafter, the operation of the present invention will be described in detail.

First, in the case where it is desired to configure the furniture hinge 1 according to the present invention, it is required that the rotator 30 should be accommodated in the elliptical hole 20 of the intermediate plate 140 and then the leg 42 of the eccentric bolt 40 should be fittingly inserted into the recessed slit 50.

By doing so, the leg 42 of the eccentric bolt 40, which is inserted into the recessed slit 50, is fittingly inserted into the fitting hole 34 of the rotator 30 so that the rotator 30 can be rotated in the forward or reverse direction along with the eccentric bolt 40 upon the forward or reverse rotation of the eccentric bolt 40.

In other words, the engagement protrusions 32 of the rotator 30 are fixedly engaged with the engagement grooves of the elliptical hole 20 or the rotator 30 is positioned in the release gap 24 while the rotator 30 is moved along the movement line 26 by a load applied to the furniture door D. Then, this process is repeatedly performed.

Figure 7:
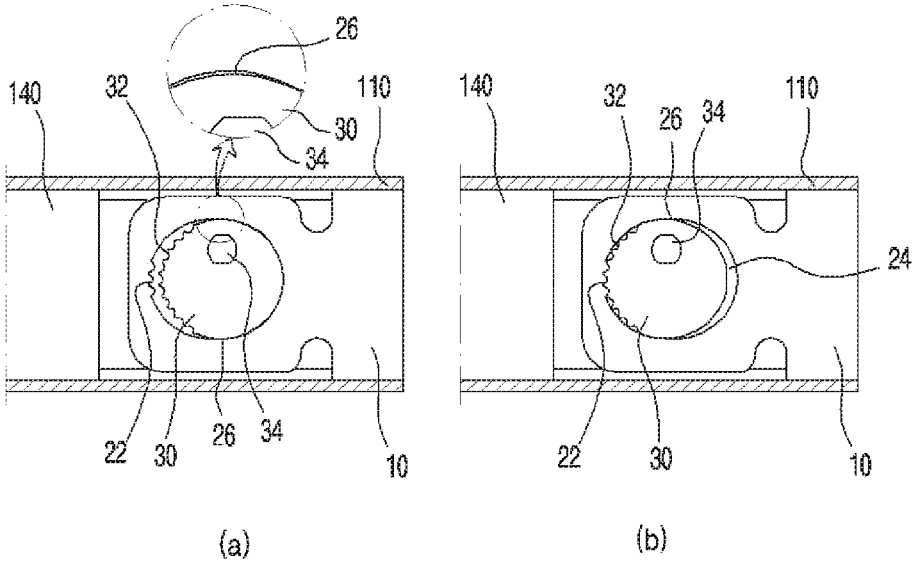
FIGS. 7(*a*) and 7(*b*) are diagrammatic views illustrating the operation process of the position adjustment mechanism of FIG. 6 in a furniture hinge according to the present invention.

As shown in FIG. 7(*a*), in case of a "natural state" in which no load is applied to the furniture door D, the rotator 30 is positioned in the release gap 24. Thus, the engagement protrusions 32 are disengaged from the engagement grooves 22.

On the other hand, as shown in FIG. 7(*b*), in the case where an external load is applied to the furniture door D, the rotator 30 is shifted to the left on the drawing sheet. Thus, the engagement protrusions 32 are engaged with the engagement grooves 22.

Figure 8:
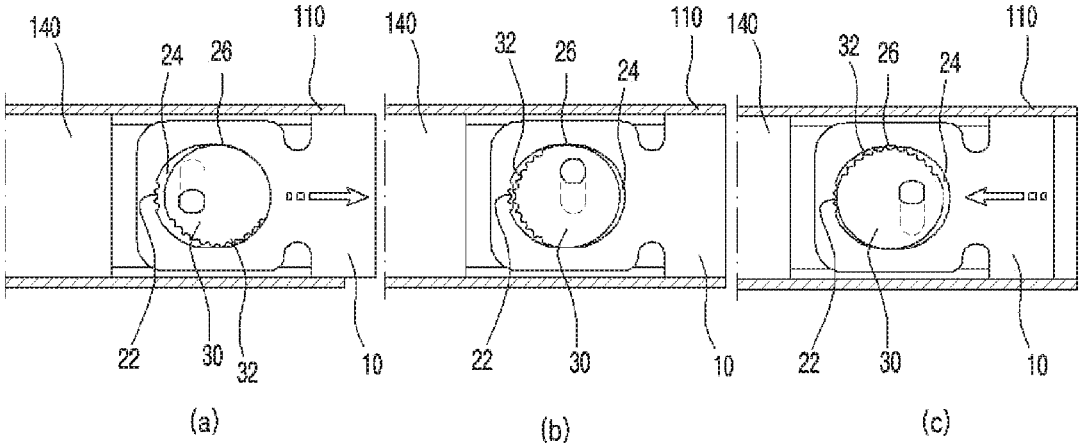
FIGS. 8(*a*) to 8(*c*) are diagrammatic views illustrating the setting process of the position adjustment mechanism of FIG. 6 in a furniture hinge according to the present invention.

Meanwhile, as shown in FIG. 8(*b*), in the case where the engagement protrusions 32 of the rotator 30 and the engagement grooves 22 of the elliptical hole 20 are not engaged with each other, the position of the furniture door D can be adjusted by the forward or reverse rotation of the eccentric bolt 40.

In this case, when the eccentric bolt 40 is rotated in forward or reverse direction, the rotator 30 is shifted toward the release gap 24 in a state of being slightly pushed so that the furniture door D is set to a state in which the rotational manipulation of the rotator 30 is possible.

As shown in FIG. 8(*a*), when the eccentric bolt 40 is rotated in a counterclockwise direction, the rotator 30 is pushingly shifted toward the release gap 24 and simultaneously the rotator 30 separated from the engagement grooves 22 is also rotated in a counterclockwise direction.

On the other hand, as shown in FIG. 8(*c*), when the eccentric bolt 40 is rotated in a clockwise direction, the rotator 30 is spaced apart from the release gap 24 and simultaneously the rotator 30 separated from the engagement grooves 22 is also rotated in a clockwise direction.

For this reason, the protrusions 32 of the rotator 30 and the engagement grooves 22 of the elliptical hole 20 can be engaged with or disengaged from each other in the counterclockwise or clockwise rotation of the eccentric bolt 40.

Therefore, the position of the body 110 is fixed or the body 110 is moved in the forward or rearward direction by the forward or reverse rotation of the eccentric bolt 40 so that although an external load is applied to the furniture door D, the eccentric bolt 40 is not rotated any more, thereby minimizing any positional displacement occurring in the process of opening or closing the furniture door D.

While the present invention has been described in connection with the exemplary embodiments illustrated in the drawings, they are merely illustrative embodiments, and the invention is not limited to these embodiments. It is to be understood that various equivalent modifications and variations of the embodiments can be made by a person having an ordinary skill in the art without departing from the spirit and scope of the present invention. Therefore, the true technical scope of the present invention should be defined by the technical spirit of the appended claims.

The invention claimed is:

1. A furniture door position adjustment device for a furniture hinge including a body (110) disposed between a furniture wall (B) and a furniture door (D), a rotating plate (120) securely fixed to the furniture door in such a manner as to be hingedly coupled to the body, and a mounting plate (130) securely fixed to the furniture wall in such a manner as to be coupled to the body, the device comprising:

a slit (50) formed on a recessed portion of the body;

an elastic piece (10) formed at an end of an intermediate plate (140) so as to perform a buffering function in a vertical direction, the elastic piece having an elliptical hole (20) formed thereon;

a rotator (30) configured to be accommodated in the elliptical hole of the intermediate plate, the rotator having a plurality of engagement protrusions (32) partially formed on the outer peripheral surface thereof; and an eccentric bolt (40) having a leg (42) formed on the underside thereof and configured to be coupled to the rotator by means of the leg so as to rotate the rotator in a forward or reverse direction upon the forward or reverse rotation of the eccentric bolt in a state in which the leg is inserted into the slit, whereby the rotator is retained on the inner peripheral surface of the elliptical hole or is moved forwardly or rearwardly along the inner peripheral surface of the elliptical hole in the forward or reverse rotation of the eccentric bolt to fix or adjust the position of the furniture door, and whereby the elliptical hole is associated with at least one engagement element so as to allow the engagement protrusions of the rotator to be engaged therewith to restrict the movement of the body to set the position of the furniture door.

2. The furniture door position adjustment device according to claim 1, wherein the at least one engagement element comprises a plurality of engagement grooves 22 formed on the inner peripheral surface of the elliptical hole so as to allow the engagement protrusions of the rotator to be engaged therewith to restrict the movement of the body to set the position of the furniture door.

3. The furniture door position adjustment device according to claim 1, wherein the number of the engagement protrusions of the rotator is larger than that of the engagement grooves of the elliptical hole.

4. The furniture door position adjustment device according to claim 1, wherein the at least one engagement element comprises a movement line (26) formed on the inner peripheral surface of the elliptical hole so as to guide the forward or rearward movement of the rotator in the forward or reverse rotation of the rotator.

5. The furniture door position adjustment device according to claim 1, wherein the at least one engagement element comprises a release gap (24).

6. The furniture door position adjustment device according to claim 1, wherein the slit is formed on a top surface of the body in the transverse direction of the body.

7. The furniture door position adjustment device according to claim 1, wherein the elliptical hole is formed on a top surface of the intermediate plate, wherein an elongate axis of the elliptical hole is substantially aligned with an elongate axis of the intermediate plate.

8. The furniture door position adjustment device according to claim 1, wherein the rotator has a support step (36) formed extending outwardly from a lower peripheral surface thereof so as to be retained by a flange portion of the elliptical hole of the intermediate plate so that the support step is used as an escape-preventive means in the rotation and movement of the rotator.

* * * * *